US006181908B1

(12) United States Patent
Leemhuis et al.

(10) Patent No.: US 6,181,908 B1
(45) Date of Patent: Jan. 30, 2001

(54) APPARATUS FOR CORRUGATING MATERIALS

(75) Inventors: Michael C. Leemhuis, Nicholasville; Daniel J. Westhoff, Georgetown, both of KY (US)

(73) Assignee: Lexmark International, Inc., Lexington, KY (US)

( * ) Notice: Under 35 U.S.C. 154(b), the term of this patent shall be extended for 0 days.

(21) Appl. No.: 09/393,244

(22) Filed: Sep. 10, 1999

(51) Int. Cl.[7] ..... G03G 15/00; B65H 29/70
(52) U.S. Cl. ..... 399/406; 271/188; 271/209
(58) Field of Search ..... 399/406; 271/188, 271/209

(56) References Cited

U.S. PATENT DOCUMENTS

| | | | | |
|---|---|---|---|---|
| Re. 33,843 | * | 3/1992 | Naramore et al. | 271/188 X |
| 3,632,107 | | 1/1972 | Rehm et al. | 271/188 |
| 4,148,475 | * | 4/1979 | Schulz . | |
| 4,203,589 | | 5/1980 | Arrasmith | 271/258.01 |
| 4,231,562 | | 11/1980 | Hori | 271/3.04 |
| 4,235,431 | | 11/1980 | Abrams et al. | 271/10.03 |
| 4,269,401 | | 5/1981 | Sargis et al. | 271/188 X |
| 4,336,929 | | 6/1982 | Hanzlik | 271/20 |
| 4,469,319 | | 9/1984 | Robb et al. | 271/3.05 |
| 4,589,650 | * | 5/1986 | Miyoshi | 271/188 X |
| 4,619,452 | * | 10/1986 | Euteneuer et al. | 271/209 X |
| 5,144,385 | * | 9/1992 | Tani | 399/406 |
| 5,152,522 | * | 10/1992 | Yamashita | 271/209 X |
| 5,153,663 | | 10/1992 | Bober et al. . | |
| 5,238,235 | * | 8/1993 | Nitta et al. . | |
| 5,280,901 | | 1/1994 | Smith et al. | 271/188 |
| 5,653,439 | | 8/1997 | Rider et al. | 271/274 |
| 5,769,412 | * | 6/1998 | Takemoto et al. | 271/188 |
| 6,012,715 | * | 1/2000 | Kasahara | 271/188 X |

FOREIGN PATENT DOCUMENTS 2-41277 * 2/1990 (JP) .

* cited by examiner

*Primary Examiner*—Susan S. Y. Lee
(74) *Attorney, Agent, or Firm*—John A. Brady

(57) ABSTRACT

An apparatus for corrugating material includes an upper shaft rotating about a first longitudinal axis and a lower shaft rotating about a second longitudinal axis. Either the upper shaft, the lower shaft, or both shafts are constructed of a flexible material. At least one upper corrugation roll is secured to the upper shaft, and at least one lower corrugation roll is secured to the lower shaft. The upper corrugation roll and the lower corrugation roll are interspersed relative to each other and spaced such that the material is fed between the upper and the lower corrugation roll to corrugate the material. Materials of varying rigidities may be passed between the upper and lower corrugation rolls such that lighter weight material is corrugated while heavier weight material deflects the flexible shaft(s) to reduce corrugation.

16 Claims, 3 Drawing Sheets

APPARATUS FOR CORRUGATING MATERIALS

BACKGROUND OF THE INVENTION

1. Field of the Invention

This invention generally relates to copiers and printers and, more particularly, to an apparatus for corrugating curled materials, such as paper, used in such copiers and printers.

2. Description of the Related Art

Many materials, such as paper, become curled after bending and/or heating. Paper may, for example, curl after one side of the paper undergoes a printing process. Electrophotographic imaging (i.e., laser printing) typically involves bonding toner to a sheet of paper using heat (typically about 400° F.). This application of heat often results in significant curling (i.e., the tendency of paper to bend in the free state) or "scrolling" (i.e., paper which is folded over onto itself) of the paper. This scrolling can cause paper jams in a laser printer. Scrolling can also cause poor stacking in an exit tray. Although this discussion focuses on paper, it is to be understood that it applies to any media to which a printing process is applied, such as paper, card stock, transparencies, envelopes, labels, etc.

Thus, the challenge is to get the printed media from the printer to span the relatively large distance from the exit rollers to the exit tray without scrolling. The larger the span distance, the higher the exit tray capacity and the greater the reliability of the media stacking. This challenge can be addressed using a corrugation system. A corrugation system is used to stiffen the paper and to prevent scrolling. Corrugation is the forming of the media with ridges and valleys parallel to the direction of travel. While more commonly used to stiffen cardboard, it can also be used to strengthen common sheets of paper. A corrugation system adds furrows and ridges to the paper, and these furrows and ridges increase the strength of the paper. It also tends to counteract curl which typically occurs perpendicular to the direction of the corrugation. This corrugation system is commonly used in laser printers to eliminate the problems associated with scrolling.

Any corrugation system must, however, compensate for a full range of paper weights used in the printer. For example, lightweight, medium weight, and heavy weight papers can be used in a printer. Lightweight paper typically requires much corrugation, whereas heavy weight paper and card stock do not often need corrugation. Further, corrugating heavy paper can result in undesirable creasing and, perhaps, ruining of the heavy weight paper. A corrugation system must, therefore, provide maximum corrugation to lightweight paper which scrolls easily, provide minimum corrugation to heavy weight paper which rarely scrolls, and not result in permanent deformation of any paper (media) type. The corrugation system should be cost effective, and the corrugation system should also be reliable for reduced warranty and service repairs. There is, accordingly, a need in the art for an apparatus that corrugates lightweight paper, yet, compensates for heavy weight paper, and an apparatus which is cost effective and reliable.

SUMMARY OF THE INVENTION

The aforementioned problems are resolved by an apparatus for corrugating material as described herein. The apparatus includes an upper shaft rotating about a first longitudinal axis and a lower shaft rotating about a second longitudinal axis. Either the upper shaft, the lower shaft, or both shafts are constructed of a flexible material. At least one upper corrugation roll is secured to the upper shaft, and at least one lower corrugation roll is secured to the lower shaft, and wherein at least one of said shafts includes at least two of said corrugation rolls. The upper corrugation roll and the lower corrugation roll are interspersed relative to each other and spaced such that the material is fed between the upper and the lower corrugation roll to corrugate the material. Materials of varying rigidities may be passed between the upper and lower corrugation rolls such that lighter weight material is corrugated while heavier weight material deflects the flexible shaft to reduce corrugation.

BRIEF DESCRIPTION OF THE DRAWINGS

These and other features, aspects, and advantages of the present invention will be better understood when the following Detailed Description is read with reference to the accompanying drawings wherein.

DETAILED DESCRIPTION

Figure 1:
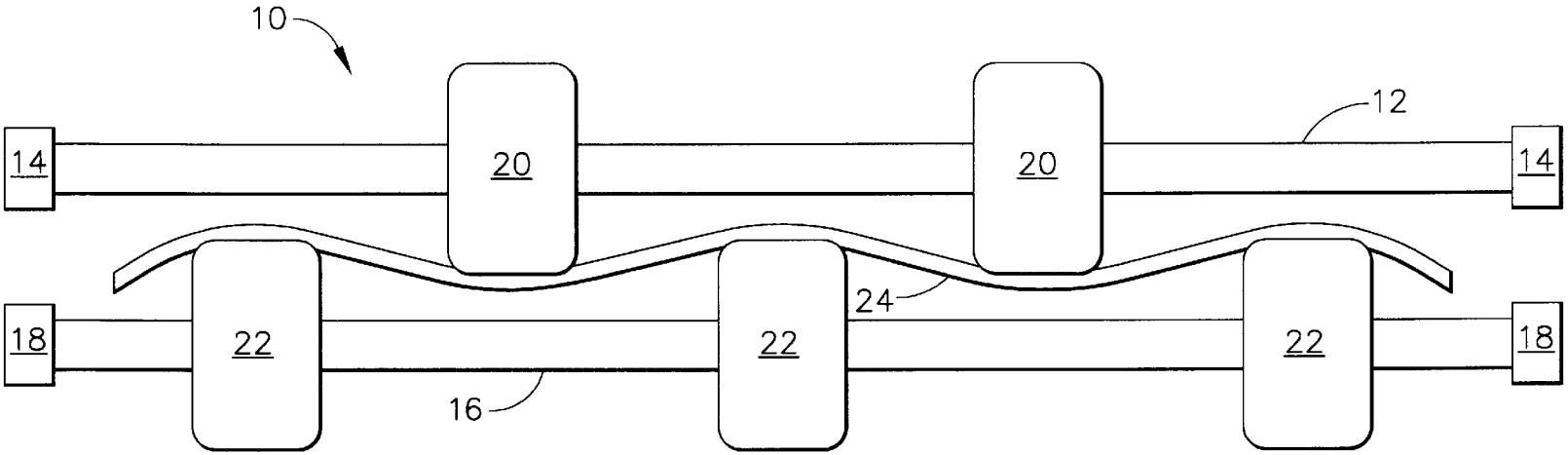
FIG. 1 is a perspective front view of an apparatus for corrugating paper according to one embodiment of the present invention.

FIG. 1 is a perspective front view of an apparatus 10 for corrugating paper according to one embodiment of the present invention. An upper flexible shaft 12 is mounted between a pair of fixed bearings 14. The pair of fixed bearings permits the upper flexible shaft to rotate about a longitudinal axis. A lower shaft 16 is substantially parallel to the upper shaft and is also mounted between a pair of fixed bearings 18. Both the lower and upper shafts can be driven (which, in fact, is preferred) or only one of the shafts can be driven while the other shaft is idle. The pair of fixed bearings 18, likewise, allows the lower shaft 16 to rotate about a longitudinal axis. At least one upper corrugation roll 20 is mounted on the upper flexible shaft 12, and at least one lower corrugation roll 22 is mounted on the lower shaft 16. Corrugation can be achieved with a minimum of three corrugation rolls—two on one shaft and one on the other shaft.

Paper 24 is fed between the upper corrugation roll(s) 20 and the lower corrugation roll(s) 22. The upper flexible shaft 12 and the lower shaft 16 are spaced such that low rigidity, lighter weight paper, such as 16# (international measure 60 $gm/m^2$), is nipped or corrugated as the lightweight paper passes between the interspersed upper and lower corrugation roll(s). The apparatus 10 corrugates the paper 24 and substantially prevents curling and paper jams.

Figure 2:
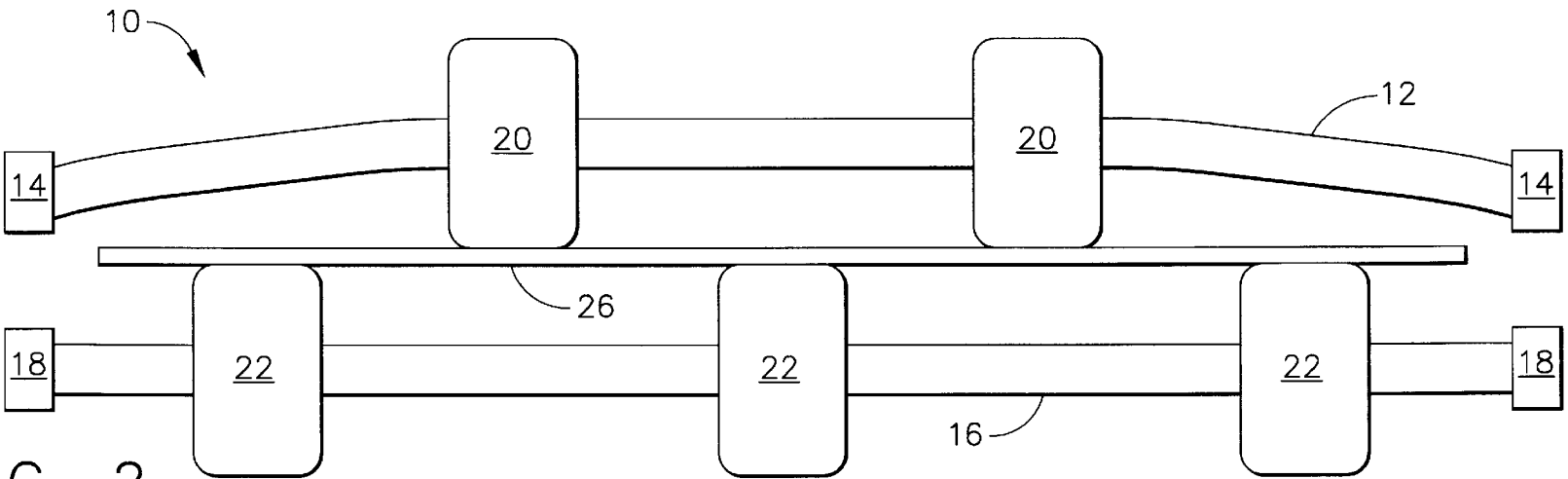
FIG. 2 is a perspective front view of the apparatus feeding heavy weight paper.

FIG. 2 is a perspective front view of the apparatus 10 feeding heavy weight paper 26. Because the upper flexible shaft 12 is made of a flexible, elastomeric material, the stiffer, rigid, heavy weight paper 26 causes the upper flexible shaft 12 to deflect. The lower shaft 16 is shown as a rigid shaft and does not deflect as the heavy weight paper passes between the upper corrugation roll(s) 20 and the lower corrugation roll(s) 22. Once the heavy weight paper clears the corrugation rolls, the upper flexible shaft returns to a non-deflected position (as shown in FIG. 1).

The flexibility of the upper flexible shaft can determine the amount of corrugation. A stiffer upper shaft deflects less as paper passes between the corrugation rolls, so the paper is subjected to greater corrugation. A limber upper shaft, conversely, would easily deflect as the paper passes between the corrugation rolls, so the paper would not be corrugated. A preferred embodiment would have a flexible shaft that corrugates only lighter weight paper, while heavy weight paper deflects the upper shaft to reduce corrugation.

When the upper flexible shaft begins to deflect (and how much it deflects) is determined by the shaft length, the shaft area moment of inertia (cross section geometry) and the shaft material. Any or all of these properties can be varied along with roller size and shaft spacing to obtain the desired corrugation. While the upper flexible shaft 12 may be made of any flexible material, in a preferred embodiment the flexible shaft is molded of a polymeric material such as nylon. A nylon material provides a desirable wear interface between the shaft and the bearings, and the nylon material is inexpensive. Stresses within the shaft are very low, so the elastic limit of nylon is not exceeded. Metals, rubber, and many other polymers, such as the polyethylenes and TEFLON (a registered trademark of E.I. du Pont de Nemours and Company), are examples of suitable material alternatives.

The shaft material may also include fibers to further vary the flexibility of the shaft. These fibers can increase the stiffness of the shaft material. The fibers can be made from a variety of materials, including cottons, silks, polymer strands, glass, and even metal filaments. Because glass fibers are readily available and inexpensive, glass fibers are used in the preferred embodiment. While a wide range of glass fiber content is possible, as the amount of fiber increases, the shaft becomes less flexible. Various fiber contents were tested, from zero percent (0%) to forty percent (40%), and a fiber content of twenty percent (20%) was determined to be suitable for the preferred embodiment.

Figure 3:
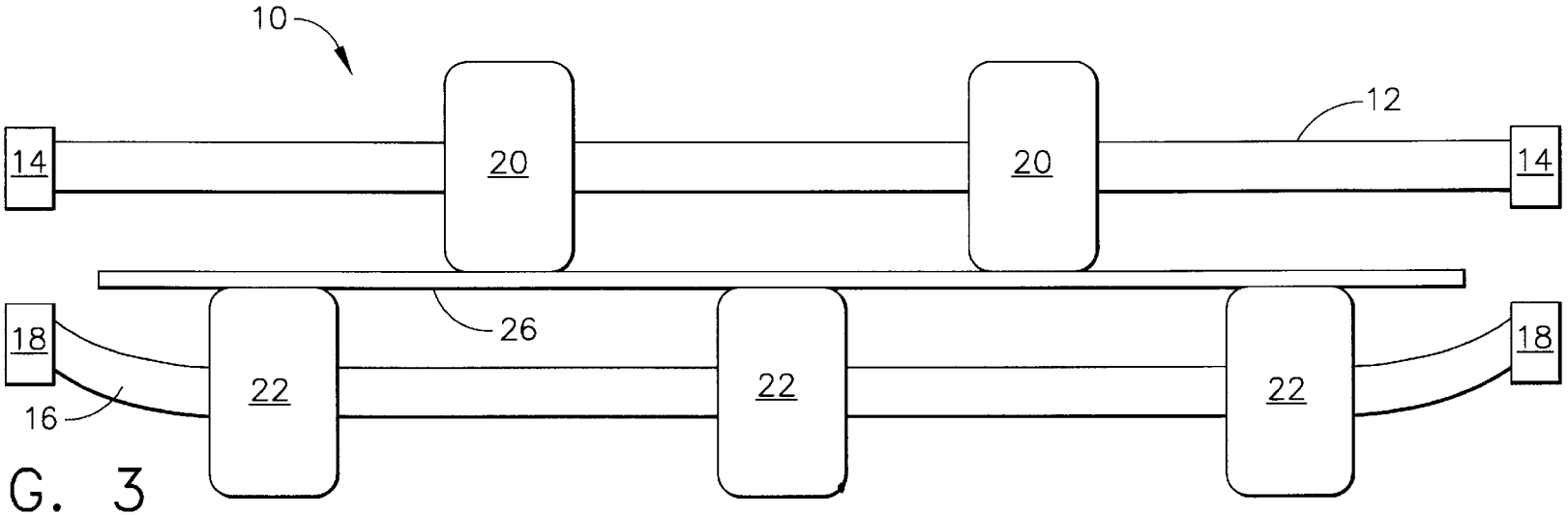
FIG. 3 is a perspective front view of another embodiment of the apparatus feeding heavy weight paper.

FIG. 3 is a perspective front view of another embodiment of the apparatus 10. The upper shaft 12, in this embodiment, is rigid while the lower shaft 16 is flexible. Because the upper shaft is rigid, only the lower shaft 16 deflects as heavy weight paper 26 passes between the upper corrugation(s) 20 and the lower corrugation roll(s) 22. Once the heavy weight paper clears the corrugation rolls, the lower flexible shaft returns to a non-deflected position (as shown in FIG. 1).

Figure 4:
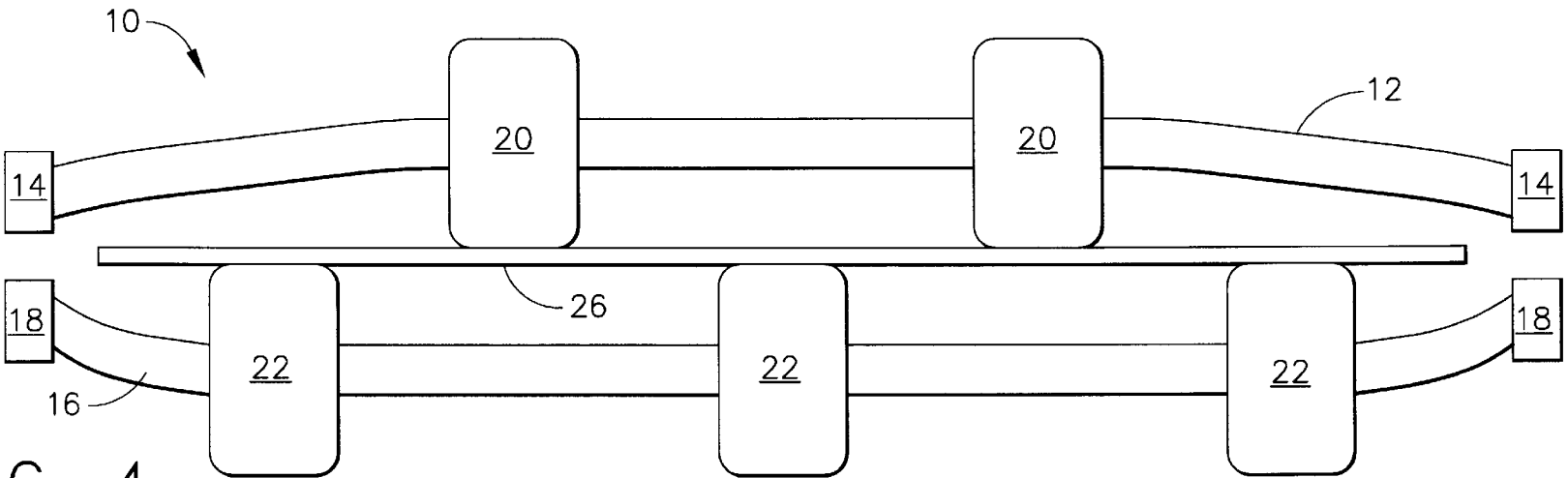
FIG. 4 is a perspective front view of still another embodiment of the apparatus feeding heavy weight paper.

FIG. 4 is a perspective front view of still another embodiment of the apparatus 10 also feeding heavy weight paper 26. In this preferred embodiment the upper shaft 12 and the lower shaft 16 are made of a flexible material. Both the upper flexible shaft 12 and the lower flexible shaft 16 deflect as the heavy weight paper 26 passes between the corrugation roll(s) 20 and 22. Because both the upper shaft 12 and the lower shaft 16 are made of a flexible material, neither shaft is subjected to the total deflection created by the heavy weight paper 26. If, for example, both the upper shaft 12 and the lower shaft 16 are made of the same material, each shaft will equally deflect as the paper 26 passes between the corrugation rolls. If, however, the upper and lower shafts are not made of the same material, those skilled in the art can selectively adjust the desired deflection of each shaft. The upper shaft 12 could, for example, be molded of a nylon material such that the upper shaft deflects more than the lower shaft 16. Because the elasticity of the shafts depends upon the diameter, the cross-section and the molded material, varying the material properties of each shaft allows the apparatus 10 to be advantageously configured for many diverse uses and for specialty products. For ease of manufacture, the shafts are generally of a uniform diameter throughout their length, although it is possible to form shafts of varying thickness for particular embodiments.

It is also possible to use shafts which are not flexible but which are mounted, such as on springs, such that they deflect out of the paper path when a heavy weight paper moves through.

Because each shaft is preferably molded of nylon, the dimensions of each shaft can easily be configured for any application. The upper and lower shafts in the preferred embodiment, for example, have a length of 240 millimeters and a diameter of nine millimeters (9 mm). The molded shafts can also have any cross-sectional shape suitable for the process application. The shafts of the preferred embodiment, for example, may have a "+" cross-sectional shape to secure the corrugation rolls. The + cross-sectional shape optimizes the molding of the shaft since minimum wall thickness reduces sink and minimizes mold cycle time.

The corrugation rolls are conveniently secured to each shaft by an overmolding operation. The overmolding process permits the corrugation rolls of the preferred embodiment to be molded of polyurethane. A polyurethane material is non-marking on white paper and has a coefficient of friction that reliably passes the paper through the apparatus. A polyurethane material also has a high wear resistance and a low material cost. While polyurethane is desirable for use with white paper, those skilled in the art will readily recognize many other materials, such as polyesters and rubber, can be used to produce the corrugation rolls.

Although the corrugation rolls are overmolded onto the shafts, those skilled in the art readily recognize many other methods could be used to secure the rolls. The rolls could, for example, be sized for a press fit onto each shaft. Snap rings or set screws could also secure the rolls.

The overmolding operation allows the upper corrugation roll(s) 20 and the lower corrugation roll(s) 22 to be individually sized and spaced for a particular application. The corrugation rolls of the preferred embodiment have a diameter of eighteen millimeters (18 mm) and a width of twelve millimeters (12 mm). The diameter of each corrugation roll, in the preferred embodiment, was chosen to match the paper speed with the flow of paper coming from an electrophotographic printer process. Those skilled in the art will recognize the diameter of the corrugation roll affects the speed (i.e., linear velocity) of the material passing through the apparatus, and those so skilled may alter the diameter to suit any application. Generally, it is preferred that all of the corrugation rolls be of the same diameter.

The overmolding operation also allows the spacing between the corrugation rolls 20, 22 to be easily altered. A narrow or "tight" spacing between the corrugation rolls will substantially increase corrugation, while a broad spacing will decrease corrugation. The upper shaft, for example, has four (4) corrugation rolls in the preferred embodiment. A center of a first upper corrugation roll is spaced about forty-four millimeters (44 mm) from an end of the upper shaft. A center of a second upper corrugation roll is spaced about seventy-six millimeters (76 mm) from this same end of the upper shaft. A center of a third and a fourth upper corrugation roll are spaced about 145 millimeters (145 mm) and about 177 millimeters (177 mm), respectively, from this same end of the upper shaft. Those skilled in the art will readily recognize the spacing between each upper corrugation roll may be altered to suit any application.

While the upper shaft has four (4) corrugation rolls, the lower shaft of the preferred embodiment has five (5) corrugation rolls. A center of a first lower corrugation roll is spaced about seventeen millimeters (17 mm) from an end of the lower shaft. A center of a second and a third lower corrugation roll are spaced about sixty millimeters (60 mm) and 116 millimeters (116 mm), respectively, from this same end of the lower shaft. A center of a fourth and a fifth lower corrugation roll are spaced about 161 millimeters (161 mm) and 209 millimeters (209 mm), respectively, from this same end of the lower shaft. Those skilled in the art will, again, readily recognize the spacing between each lower corrugation roll may be altered to suit any application.

Figure 5:
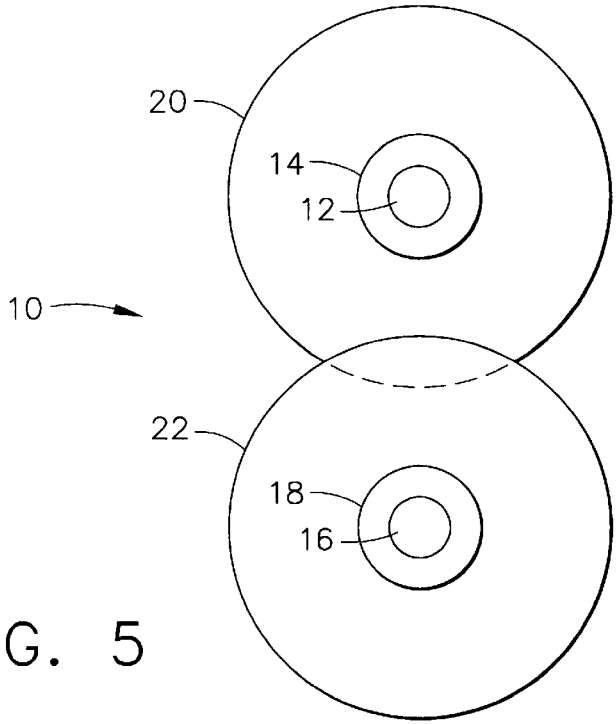
FIG. 5 is a perspective side view of the apparatus of FIGS. 1–4.

FIG. 5 is a perspective side view of the apparatus 10 of FIGS. 1–4. The upper shaft 12 is shown substantially parallel and coplanar with the lower shaft 16. The bearings 14 and 18 allow the respective shafts 12 and 16 to rotate along respective longitudinal axes. The upper corrugation roll(s) 20 and the lower corrugation roll(s) 22 may be spaced relative to one another to achieve any desired corrugation. While the spacing between the upper shaft 12 and the lower shaft 16 is approximately 15.85 millimeters in the preferred embodiment, a spacing of between fifteen to sixteen millimeters (15 mm–16 mm) was initially investigated. This range is narrow due to past fixed shaft implementations, however, those skilled in the art readily recognize the spacing may be altered to suit any particular application.

Because the corrugation rolls are eighteen millimeters (18 mm) in diameter, this spacing between the shafts produces a corrugation interference of 2.15 millimeters in an undeflected condition (as is shown with reference to FIG. 1). This 15.85 mm spacing appears optimal for a range of paper from 16# (international measure 60 gm/m$^2$) to 110# (international measure 413 gm/m$^2$). A smaller spacing provides more corrugation of lightweight paper, but, tends to damage and to over-corrugate heavier weight paper. A greater spacing reduces the corrugation of lighter weight paper and begins to diminish the effectiveness of the endeavor. Those skilled in the art will, again, readily recognize the spacing between the shafts may be easily altered (keeping in mind the diameter of the corrugation rolls utilized) to suit any particular application.

Figure 6:
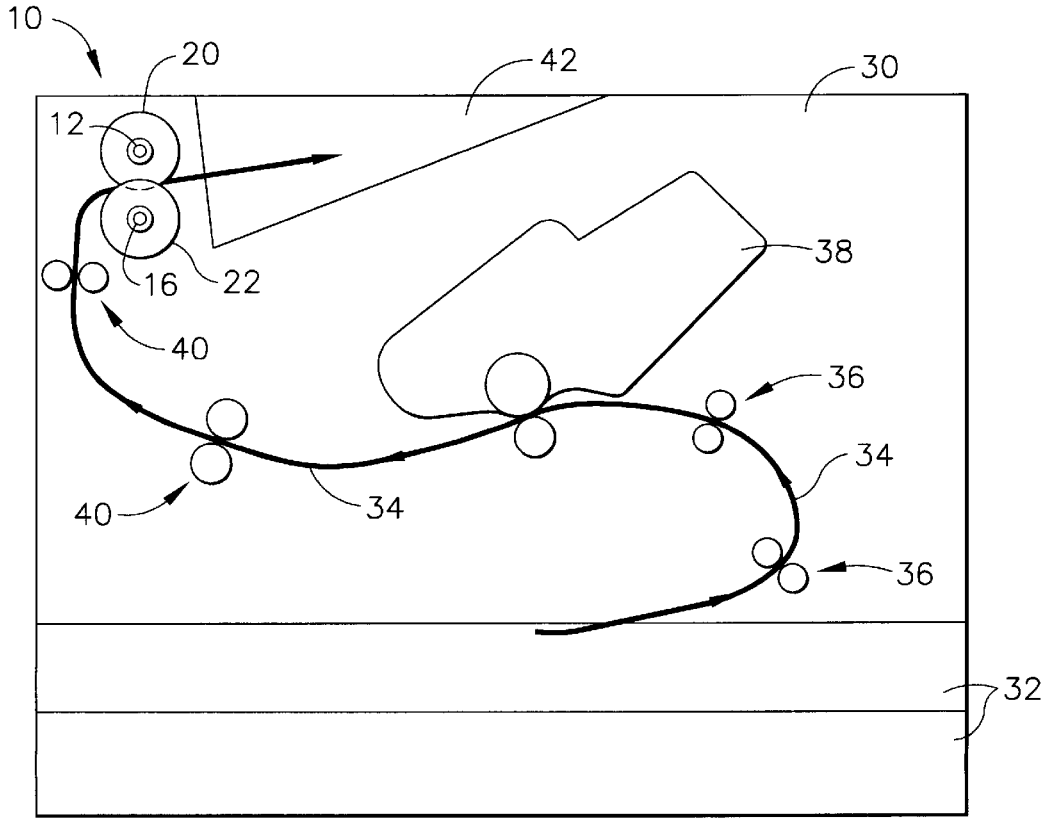
FIG. 6 shows the apparatus of FIGS. 1–5 operating in an electro-photographic printer.

FIG. 6 shows the apparatus of FIGS. 1–5 operating in an electro-photographic printer, such as that manufactured by LEXMARK™ of Lexington, Ky. A side view of the apparatus 10 is shown enlarged for clarity. The printer 30 includes a paper supply 32 containing at least one sheet of paper 34. The paper supply is typically a cassette tray contained in a lower portion of the printer. An input system 36 feeds the paper to a print engine 38. The print engine is responsible for writing, transferring, and fusing an image on the paper as is conventionally known in the art. The heat of the print engine causes the paper to curl, or "scroll," so an output system 40 feeds the paper 34 into the apparatus 10 for corrugation.

The sheet of paper 34 is fed between the upper corrugation roll 20 and the lower corrugation roll 22. A lightweight paper, such as 16# (international measure 60 gm/m$^2$), may not deflect either the upper shaft 12 or the lower shaft 16, so the lightweight paper is corrugated (as shown in FIG. 1). A heavy weight paper, such as 90# (international measure 338 gm/m$^2$), will deflect either the upper shaft 12 or the lower shaft 16 or both (as previously shown and discussed above with reference to FIGS. 2–4). The upper shaft and the lower shaft may optionally be driven to improve corrugation and delivery of the sheet of paper to an output tray 42.

While the apparatus is described for use in corrugating sheets of paper, those skilled in the art will recognize the apparatus may be used to corrugate very heavy weight paper products, such as card stock, cardboard, labels and envelopes. The apparatus may also be used to corrugate non-paper materials such as transparencies, steels, polymers, wood pulps and wood fibers, silks, and cottons.

Although the upper and lower shafts are shown substantially parallel, those skilled in the art recognize the shafts need not be parallel. The shafts may, in fact, be arranged in a non-parallel configuration to corrugate folded products. Envelopes, for example, may require more corrugation on one side and less corrugation on a folded side. A nonparallel arrangement of the upper and lower shaft will permit one section of the material to be corrugated more than an opposite section.

Furthermore, those skilled in the art recognize the upper shaft and the lower shaft need not be coplanar. A nonplanar arrangement of the upper and lower shaft may permit the apparatus to route the paper as the paper exits the apparatus.

Although the corrugation rolls are shown and described as having equivalent diameters, those skilled in the art recognize the rolls could have varying diameters in the same application. For example, corrugation rolls at one end of a shaft may have a larger diameter than the rolls at an opposite end of the same shaft. These larger diameter rolls would produce greater corrugation interference and would, therefore, locally increase corrugation. This greater corrugation could be advantageous for folded paper products, such as envelopes.

While the apparatus is shown as comprising only two shafts, those skilled in the art recognize more than two shafts could be used to corrugate the material. A three-shaft apparatus could be designed, for example, in which an upper shaft, a middle shaft, and a lower shaft cooperate to corrugate materials. Any number of shafts could, in fact, cooperate to corrugate materials.

Those skilled in the art will also recognize the flexible shafts could be constructed of various metals. The shafts, for example, could be constructed similar to metal rods. The diameter of the metal rod, and the metal material itself, could determine the amount of flexibility for a particular application. Each flexible shaft could also be constructed of flat metal strips, and the thickness and width of each strip could determine the amount of flexibility.

While the present invention has been described with respect to various features, aspects, and embodiments, those skilled and unskilled in the art will recognize the invention is not so limited. Other variations, modifications, and alternative embodiments may be made without departing from the spirit and scope of the present invention.

What is claimed is:

1. An apparatus for corrugating material, the apparatus comprising:

an upper shaft capable of rotating about a first longitudinal axis and a lower shaft capable of rotating about a second longitudinal axis, at least one of said shafts being constructed of a flexible material;

at least two upper corrugation rolls secured to the upper shaft, and at least two lower corrugation rolls secured to the lower shaft, wherein at least one of said upper and lower shafts include at least three of said corrugation rolls, and said upper and lower corrugation rolls are interspersed relative to each other and spaced to corrugate the material when the material is passed therebetween;

wherein when the material passes between the upper and lower corrugation rolls, lighter weight material is corrugated while heavier weight material deflects one or more of said shafts to reduce corrugation.

2. An apparatus for corrugating material according to claim 1, wherein the apparatus corrugates the material in proportion to the rigidity of the material passing between the upper and the lower corrugation roll.

3. An apparatus for corrugating material according to claim 1, wherein the upper shaft is constructed of flexible material.

4. An apparatus for corrugating material according to claim 1, wherein the lower shaft is constructed of flexible material.

5. An apparatus for corrugating material according to claim 3, wherein the upper shaft is constructed of a polymeric material.

6. An apparatus for corrugating material according to claim 1, wherein each upper corrugation roll and each lower corrugation roll are constructed of polyurethane material.

7. An apparatus for corrugating material, the apparatus comprising:

an upper shaft rotating about a first longitudinal axis, the upper shaft constructed of a flexible material;

a lower shaft rotating about a second longitudinal axis, the lower shaft constructed of a flexible material;

at least one upper corrugation roll secured to the upper shaft, and at least one lower corrugation roll secured to the lower shaft, wherein at least one of said upper and lower shafts include at least two of said corrugation rolls, and said upper and lower corrugation rolls are interspersed relative to each other and spaced to corrugate the material when the material is passed therebetween;

wherein when the material passes between the upper and lower corrugation rolls, lighter weight material is corrugated while heavier weight material deflects both the upper shaft and the lower shaft to reduce corrugation.

8. An apparatus for corrugating material according to claim 7, wherein the apparatus corrugates the material in proportion to the rigidity of the material passing between the upper and the lower corrugation roll.

9. An apparatus for corrugating material according to claim 7, wherein the upper shaft and the lower shaft drive the material through the apparatus.

10. An apparatus for corrugating material according to claim 7, wherein the upper shaft and the lower shaft are constructed of a polymeric material.

11. An apparatus for corrugating material according to claim 10, wherein the polymeric material is nylon.

12. An apparatus for corrugating material according to claim 7, wherein each corrugation roll is constructed of polyurethane.

13. An electrophotographic printer for printing an image on a sheet of paper, the printer comprising:

an input system;

a print engine for producing the image on the sheet of paper, the input system delivering the sheet of paper to the print engine;

an apparatus for corrugating the sheet of paper, the apparatus receiving the sheet of paper from the print engine, the apparatus including an upper shaft rotating about a first longitudinal axis, a lower shaft rotating about a second longitudinal axis, at least one of said shafts being constructed of a flexible material, at least two upper corrugation rolls secured to the upper shaft, and at least two lower corrugation rolls secured to the lower shaft, wherein at least one of said upper and lower shafts include at least three of said corrugation rolls, and said upper and lower corrugation rolls are interspersed relative to each other and spaced to corrugate the sheet of paper when the sheet of paper is passed therebetween;

wherein when the sheet of paper passes between the upper and lower corrugation rolls, lighter weight paper is corrugated while heavier weight paper deflects one or more of said shafts to reduce corrugation.

14. An electrophotographic printer according to claim 13, wherein the upper shaft and the lower shaft are constructed of a flexible material such that lighter weight paper is corrugated while heavier weight paper deflects both the upper shaft and the lower shaft to reduce corrugation.

15. An electrophotographic printer according to claim 13, wherein the upper shaft is constructed of a flexible material such that lighter weight paper is corrugated while heavier weight paper deflects the upper shaft to reduce corrugation.

16. An electrophotographic printer according to claim 13, wherein the lower shaft is constructed of a flexible material such that lighter weight paper is corrugated while heavier weight paper deflects the lower shaft to reduce corrugation.

* * * * *